US009797151B2

(12) United States Patent
Sallent Puigcercos

(10) Patent No.: US 9,797,151 B2
(45) Date of Patent: Oct. 24, 2017

(54) ARRANGEMENT OF CINEMAS IN MULTIPLEX CINEMAS AND CINEMA ROOM FOR A MULTI-SCREEN CINEMA

(71) Applicant: VALLESVIU, S.A., Barcelona (ES)

(72) Inventor: Pere Maria Sallent Puigcercos, Barcelona (ES)

(73) Assignee: VALLESVIU, S.A. (ES)

( * ) Notice: Subject to any disclaimer, the term of this patent is extended or adjusted under 35 U.S.C. 154(b) by 0 days.

(21) Appl. No.: 15/267,228

(22) Filed: Sep. 16, 2016

(65) Prior Publication Data

US 2017/0073988 A1 Mar. 16, 2017

(30) Foreign Application Priority Data

Sep. 16, 2015 (EP) ..... 15185387
Sep. 16, 2015 (ES) ..... 201531312

(51) Int. Cl.

| | |
|---|---|
| ***E04H 3/30*** | (2006.01) |
| ***A63J 25/00*** | (2009.01) |
| ***E04H 3/22*** | (2006.01) |
| *E04B 1/00* | (2006.01) |

(52) U.S. Cl.

CPC ..... *E04H 3/30* (2013.01); *A63J 25/00* (2013.01); *E04H 3/22* (2013.01); *E04B 2001/0053* (2013.01)

(58) Field of Classification Search

CPC ..... E04H 3/30; E04H 3/22; E04B 2001/0053; A63J 25/00

USPC ..... 52/6, 8

See application file for complete search history.

(56) References Cited

U.S. PATENT DOCUMENTS 1,397,064 A * 11/1921 Togersen ..... E04H 3/22 52/8
3,002,233 A * 10/1961 Obata ..... E04H 3/30 52/236.1
3,257,154 A * 6/1966 Lewis ..... A47B 49/00 312/198
3,487,595 A * 1/1970 Schumann ..... E04H 3/10 52/236.2
4,000,589 A * 1/1977 Bianchini ..... E04B 1/34815 52/236.1
4,690,467 A * 9/1987 Imbert ..... A47B 81/00 211/60.1
5,433,670 A * 7/1995 Trumbull ..... A63G 31/16 352/85
5,469,669 A * 11/1995 Alter ..... E04H 3/22 52/6

(Continued)

*Primary Examiner* — Brent W Herring
(74) *Attorney, Agent, or Firm* — Hoglund & Pamias, PSC; Roberto J. Rios

(57) ABSTRACT

The present invention relates to an arrangement of cinemas in multiplex cinemas, comprising: at least one first row (1) of contiguous cinemas (1*a*) provided with a projection screen (P) and with stadium-type seating (G) arranged on an inclined surface (15). The cinemas (1*a*) of the first row have a trapezoidal layout with: a larger end (11) where the projection screen (p) is arranged, a smaller end (12), and two oblique sides (13, 14). The present invention also relates to an arrangement for a cinema room for a multi-screen cinema, in which each of the cinema rooms has a film projector (1), a screen (2) and tiers of seats (3) with multiple rows of seats (3*a*, 3*b*, . . . , 3*n*) arranged to different heights.

3 Claims, 6 Drawing Sheets

(56) References Cited

U.S. PATENT DOCUMENTS

| | | | | | |
|---|---|---|---|---|---|
| 5,829,201 | A * | 11/1998 | Schelter | A47C 1/124 | 414/921 |
| 6,164,018 | A * | 12/2000 | Runge | E04H 3/22 | 52/174 |
| 8,955,258 | B2 * | 2/2015 | Jacques | E04H 3/22 | 52/2.11 |
| 9,140,027 | B2 * | 9/2015 | Ramirez Magana | E04H 3/22 | |
| 9,234,363 | B1 * | 1/2016 | Magana | E04H 3/22 | |
| 2002/0001064 | A1 * | 1/2002 | Graves | G03B 21/56 | 352/1 |
| 2003/0131537 | A1 * | 7/2003 | Krikorian | E04H 3/22 | 52/6 |
| 2005/0252100 | A1 * | 11/2005 | Nord | E04H 1/02 | 52/79.4 |
| 2013/0167452 | A1 * | 7/2013 | Jacques | E04H 3/22 | 52/2.18 |
| 2014/0311046 | A1 * | 10/2014 | Ramirez | E04H 3/30 | 52/8 |
| 2016/0153208 | A1 * | 6/2016 | Oehl | E04H 3/22 | 52/6 |

* cited by examiner

ARRANGEMENT OF CINEMAS IN MULTIPLEX CINEMAS AND CINEMA ROOM FOR A MULTI-SCREEN CINEMA

TECHNICAL FIELD

The invention relates generally to the field of multiplex cinemas, and in particular, to the arrangement of the cinemas and the cinema rooms.

BACKGROUND OF THE INVENTION

Multiplex cinemas having several cinemas for projecting films are well known today. These multiplex cinemas are often installed in shopping malls or in specific premises, where suitable optimization of space is required. Multiplex cinemas in which the projection cinemas have a rectangular shape and are arranged forming alignments of contiguous cinemas are known, said cinemas having a projection screen at a first end of the cinema and stadium-type seating arranged on an inclined surface, inclined upwards towards a second end of the cinema. The rectangular shape of cinemas is adopted following the quadrangular distribution pattern of the posts of the building; this means that depending on the separation between posts, the projection cinema can have a smaller width, which limits the width of the screen and can even call into question the validity of the space for installing a multiplex cinema. Some arrangements applicable to entertainment halls are known in the prior art. For example, the utility model ES0246078U discloses a central area isolated by means of a peripheral partition of a series of individual chamber-type housings for viewers. Spanish patent ES0185779 discloses improvements to the arrangement of film projection cinemas, combining a ramp that is lit up with indirect lighting oriented towards the exterior which frames the screen and replaces the usual black framing with an unnoticeable attachment of the walls of the cinema to the walls of the ramp. However, the proprietor of the present invention is unaware of the existence of any background document that allows satisfactorily solving the problems considered in reference to making optimal use of the space in multiplex cinemas and maximizing the width of projection screens.

Multi-screen cinemas are currently known, having a flat screen or a variable curvature screen vertically arranged, on which frontal screen images are projected by means of film projectors located behind the projecting cinema room, higher than the tiers of seats. This arrangement of the film projectors brings about various problems among which the following may be cited:

- the utilization of a part of the space aimed at the cinema room for building behind the room the projection cabins and a corridor for its access;
- a limited utilization of the light of the projection and visual deformation of the projected image on the screen due to the high location of the projector in respect to the screen and to the difference in the horizontal angle visualization in respect to the viewers, in function of their location within the cinema room;
- in case of screens of large dimensions, the lack of capacity to offer sufficient luminosity forces frequently to the use of a simultaneous projection with two projectors in each of the cinema rooms, with the assistance of mirrors or prisms which generate eventual convergence problems of the images on the screen.

The difference in the visualization angle and comfort for the viewer between the first and the last rows of the cinema room is well known by the users, who avoid the occupation of the firsts rows or lower rows of seats in which they must adopt an uncomfortable position, having at the same time a worse vision of the images; specially in small or medium sized cinema rooms. While it is true that projection rooms exist with characteristics oriented to obtain especial effects, as the known "OMNIMAX" cinema rooms, which use a screen with a surface similar to a an spherical quadrant; the inventor does not know the existence of prior art embodiments applicable to multi-screen cinemas having an arrangement similar to the present invention and solving satisfactorily the above related problems.

SUMMARY OF THE INVENTION

The object of the present invention is an arrangement of projection cinemas in multiplex cinemas, comprising: at least one first row of contiguous cinemas provided with a projection screen at a first end, with stadium-type seating for viewers arranged on an inclined surface, inclined upwards towards a second end of the cinema, and entrances to the mentioned cinemas. The arrangement of cinemas in multiplex cinemas object of this invention comprises features which are aimed at optimizing space in a premises intended for a multiplex cinema for placement of the projection cinemas and maximizing screen size.

The arrangement of cinemas in multiplex cinemas object of this invention, comprising at least one first row of contiguous cinemas provided with a projection screen at a first end and with stadium-type seating arranged on an inclined surface, inclined upwards towards a second end of the cinema, in addition to entrances to said cinemas, has constructive particularities aimed at solving the problems set forth and optimizing space and maximizing screen size such that all the cinemas have a large screen. To that end and according to the arrangement of the invention, the multiplex cinema comprises at least one first row of cinemas having a trapezoidal layout with: a larger end, a smaller end and two oblique sides. The cinemas of said first row are attached to one another by their sides and with their larger and smaller ends oriented in opposite directions with respect to said ends of the contiguous cinema or cinemas. The alternating orientation of the contiguous trapezoidal cinemas allows maximizing the dimensions of the larger end of the cinemas and placing a large screen there, or in any case a screen that is larger than one that may be used in a rectangular cinema having the same length and surface.

In this invention, the possibility of arranging below the inclined surface of the cinemas of the first row lower cinemas having a trapezoidal layout, having a smaller surface than those of the first row, has been envisaged, said lower cinemas also having: a smaller end, a larger end and two oblique sides. The lower cinemas are arranged with their smaller end oriented in the same direction as the smaller end of the cinemas of the mentioned first row. In this embodiment, the smaller end of the lower is vertically aligned with the smaller end of the cinemas of the first row, making use of the greater height of said smaller end of the lower cinema for placing the corresponding screen.

A further object of this invention is a cinema room for a multi-screen cinema, each cinema room having a film projector, a projection screen and tiers of seats or stands with multiple rows of seats arranged to different heights. The arrangement of the invention has peculiarities in its construction concerning the location of the film projector and the arrangement of the screen, providing multiple advantages concerning the management of the space intended for a multi-screen cinema, improving the quality of the projection by minimizing the deformation of the image projected on the screen, providing a better utilization of the projector light and maintaining the format of the projection in which the movie has been created, as well as obtaining the same horizontal vision angle for all of the seats, independently of the position of the seats in the room and independently of the dimensions of the room, improving the visualization of the movie by the public.

The arrangement for a cinema room for a multi-screen cinema which is the object of the invention, having in each cinema room a projection screen, a film projector and a tiers of seats, has features aimed at solving the above problems of the presently known cinema rooms for multi-screen cinemas. For this purpose and according to the invention, a feature of the present arrangement for cinema rooms for a multi-screen cinema consists in that each of the projection rooms has a projection screen with a surface which adopts the form of a cylindrical sector with constant curvature, being said projection screen tilted towards the tiers of seats, forming said screen an angle with the vertical comprised between 5° and 10°, preferably 7°. With the inclination of the screen and its configuration in the form of a cylindrical sector, an immersion sensation is obtained by the viewers in respect to the scenes projected on the screen as well as a better aspect of the projections.

Another feature consists in the arrangement of the film projector inside of each cinema room, integrated in an intermediate area of the tiers of seats, and oriented towards the centre of the screen, forming with said screen an angle comprised between 80° and 100°, the objective being an angle of 90° with absolute perpendicularity in respect of the screen. This peculiarity permits the integration in the cinema room of the spaces usually located behind the room and aimed at containing the projection cabins, so that a better utilization is obtained of the space for the parterre.

Said arrangement of the film projector, apart from preventing the deformation of the images, which occurs usually in the cinema rooms in which the film projector is arranged above the tiers of seats; permits a better utilization of the projector light given the perpendicularity of the projection in respect to the screen, being unnecessary, in case of large surface screens, the simultaneous use of two film projectors and intermediate elements for re-directing towards the screen and the convergence on the screen of the images coming from the two film projectors which operate simultaneously. Furthermore, with this arrangement of the film projector, the light cast on the screen returns to the central area of the tiers of seats, improving the luminosity of the projection. With the arrangement of a unique film projector in the central or intermediate areas of each cinema room, it is possible to minimize the difference in vertical deformation among the different rows of seats, which together with the configuration of the screen in the form of a cylindrical sector, provides an optimized vision of the images by the viewers. Further, the inclination of the screen towards the tiers of seats or parterre provides the same angle for horizontal vision from all the seats, independently of the dimensions of the cinema room.

Additionally, and with the end to optimise the comfort of the users, at least the first row or seats or lower row of seats has bed-like seats, in which the viewers can arrange themselves lying or seating with a larger inclination than in the rest of seats of the rows of seats located behind, improving the comfort of the viewers.

BRIEF DESCRIPTION OF THE DRAWINGS

To complement the description that is being made and for the purpose of aiding understanding of the features of the invention, a set of drawings is attached to the present specification in which the following is depicted with an illustrative and non-limiting character.

DETAILED DESCRIPTION OF THE INVENTION

Arrangement of Cinemas

Figure 1:
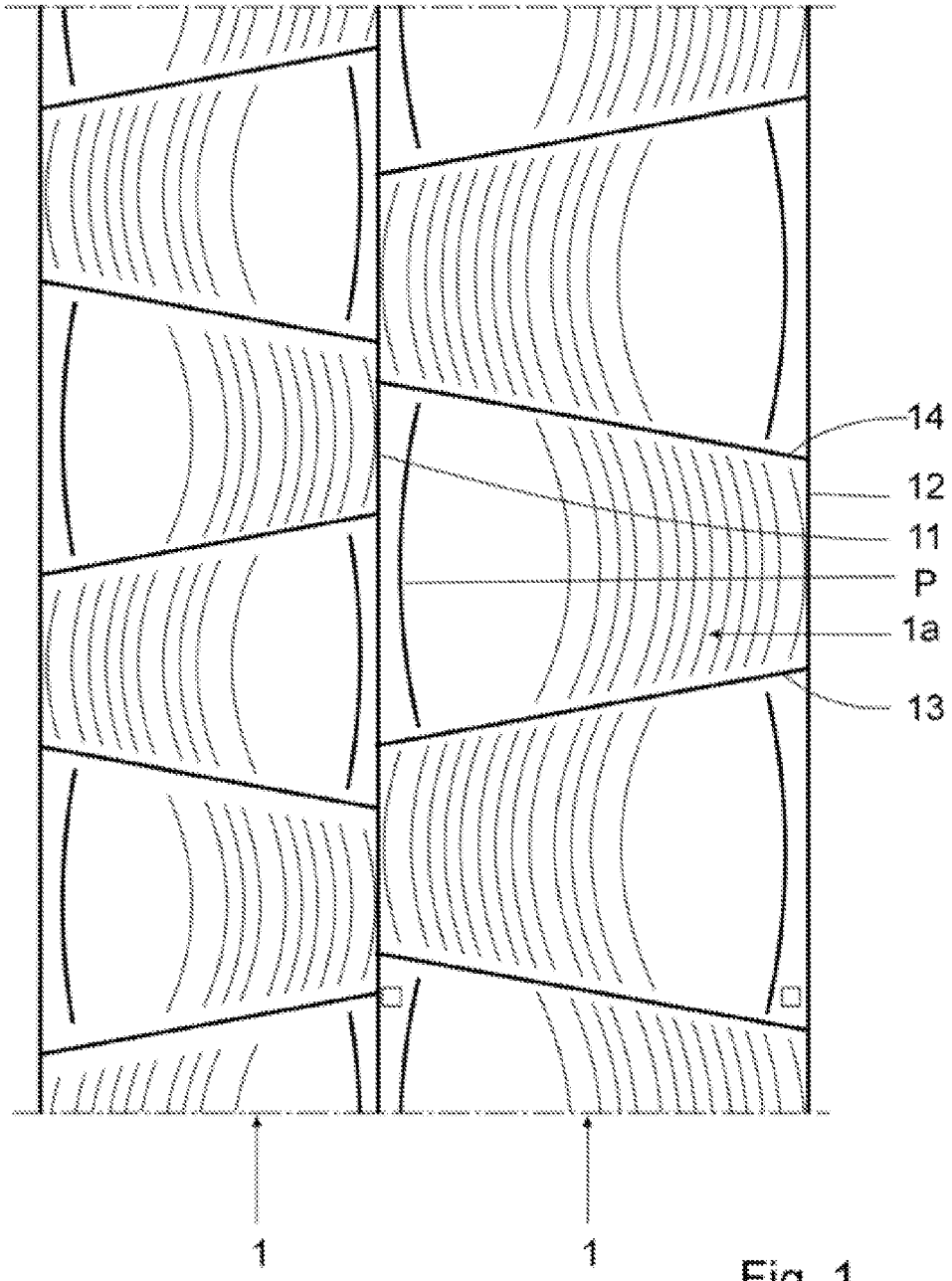
FIG. 1 shows a top plan view of an embodiment of the arrangement of cinemas in multiplex cinemas, in which two first rows of trapezoidal cinemas can be seen.
Figure 2:
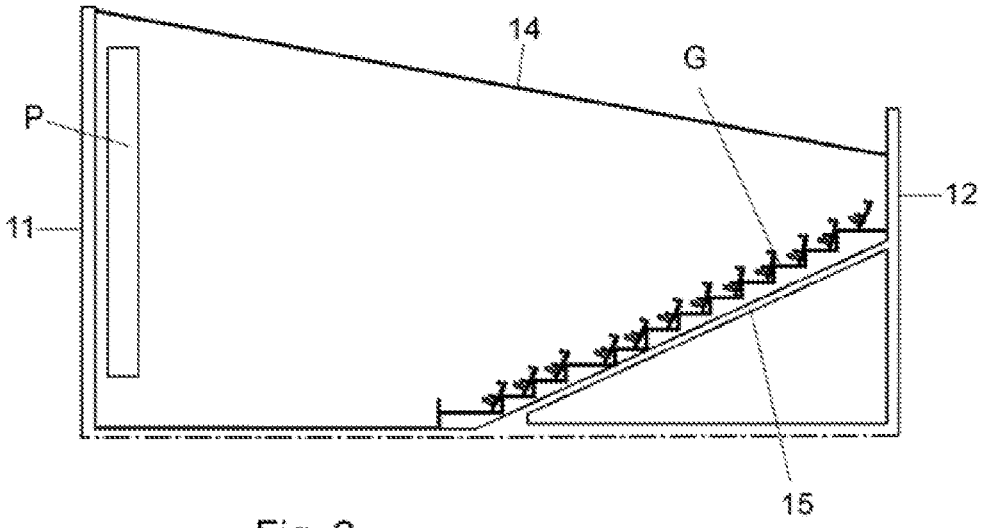
FIG. 2 shows an elevation view of one of the cinemas of FIG. 1 sectioned by a vertical plane.

The embodiment shown in FIG. 1 shows cinemas (1*a*) of a multiplex cinema forming two first rows (1) of contiguous cinemas (1*a*). All the cinemas (1*a*) have a trapezoidal layout with a larger end (11), a smaller end (12) and two oblique sides (13, 14), the cinemas (1*a*) being attached to one another by their sides and with their larger and smaller ends (11, 12) oriented in opposite directions with respect to those of the contiguous cinema or cinemas (1*a*) of the same first row (1). Each of the cinemas (1*a*) is provided with a projection screen (P) arranged at a larger end (11) of the cinema and with stadium-type seating (G) arranged on an inclined surface (15), inclined upwards towards the smaller end (12) of the cinema. The trapezoidal configuration of the cinemas (1*a*) allows using their larger end (11) for installing a large screen (P).

Figure 3:
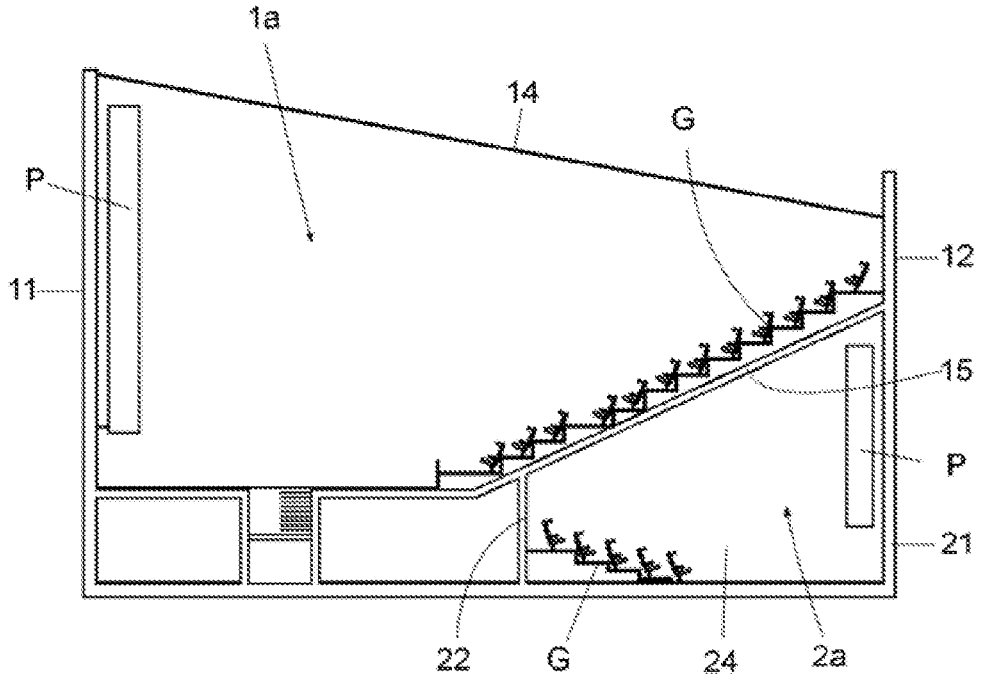
FIG. 3 shows an elevation view, sectioned by a vertical plane, of an embodiment incorporating a second row of trapezoidal cinemas, arranged below the inclined surface of the cinemas of the first row of cinemas.
Figure 4:
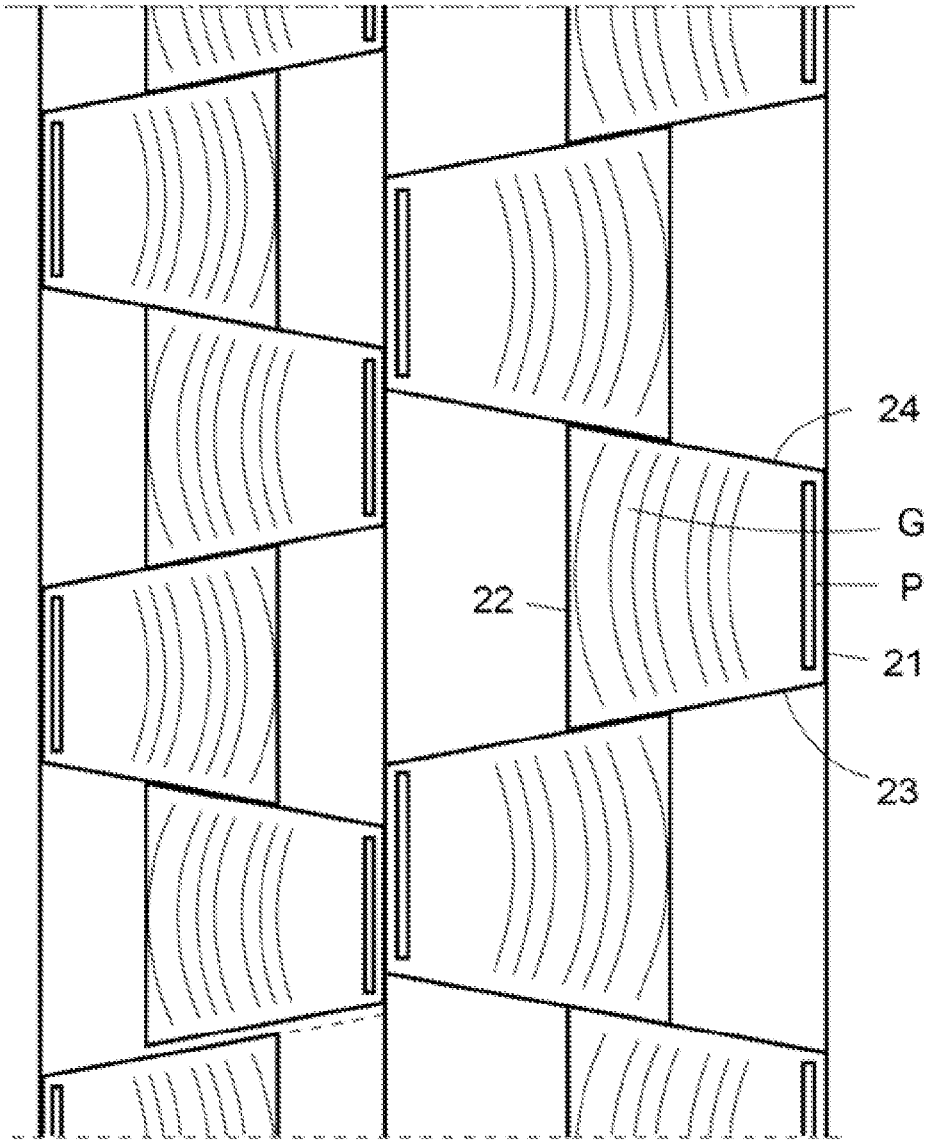
FIG. 4 shows a top plan view of an example of the distribution of the lower cinemas arranged below the rows of cinemas shown in FIG. 1.

In the embodiment variant shown in FIGS. 3 and 4, the possibility of arranging lower cinemas (2*a*) having a trapezoidal layout and a smaller size below the cinemas (1*a*) of the first rows (1) is contemplated. The lower cinemas (2*a*) have a trapezoidal layout defined by a smaller end (21), a larger end (22) and two oblique sides. The mentioned lower cinemas (2*a*) are arranged below the inclined surface (15) of the cinemas (1*a*) as shown in FIG. 3, making use of the space of the mentioned lower cinemas (2*a*) having the greatest height for placing the screens (P).

Cinema Room

Figure 5:
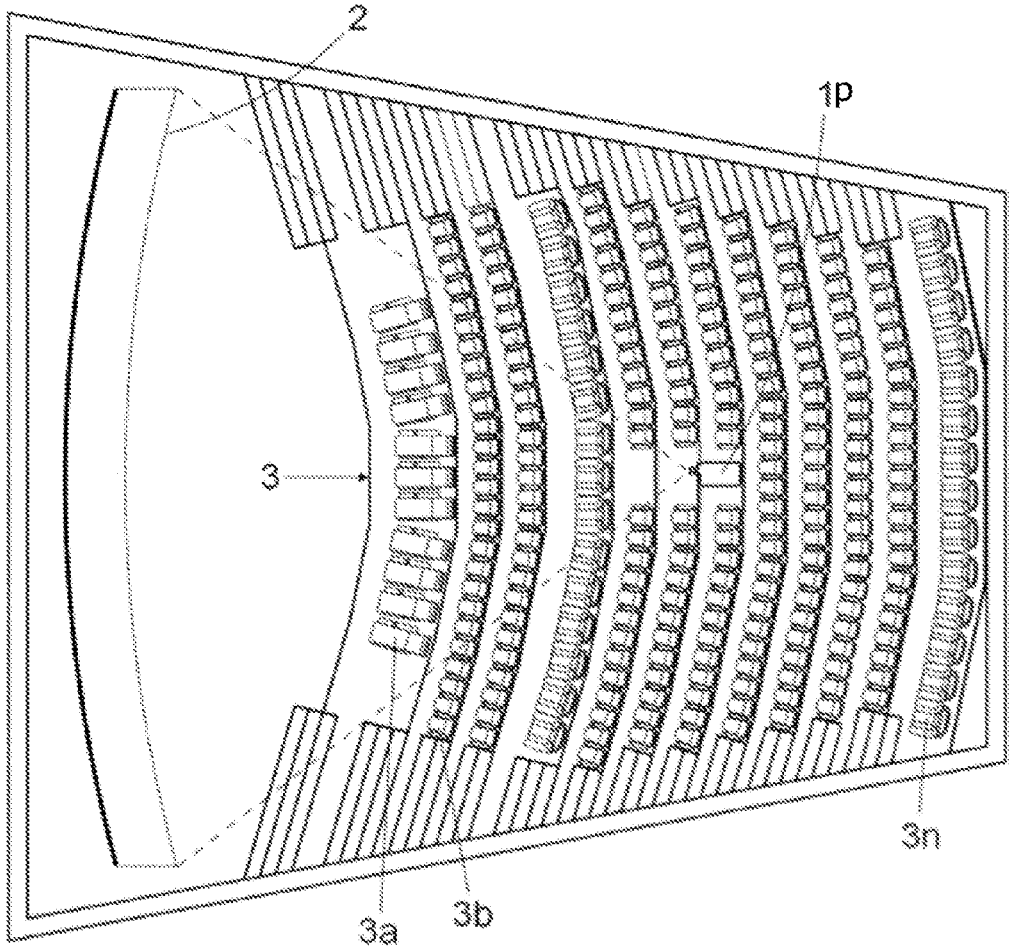
FIG. 5 shows a plant view of an example embodiment of a cinema room for a multi-screen cinema.
Figure 6:
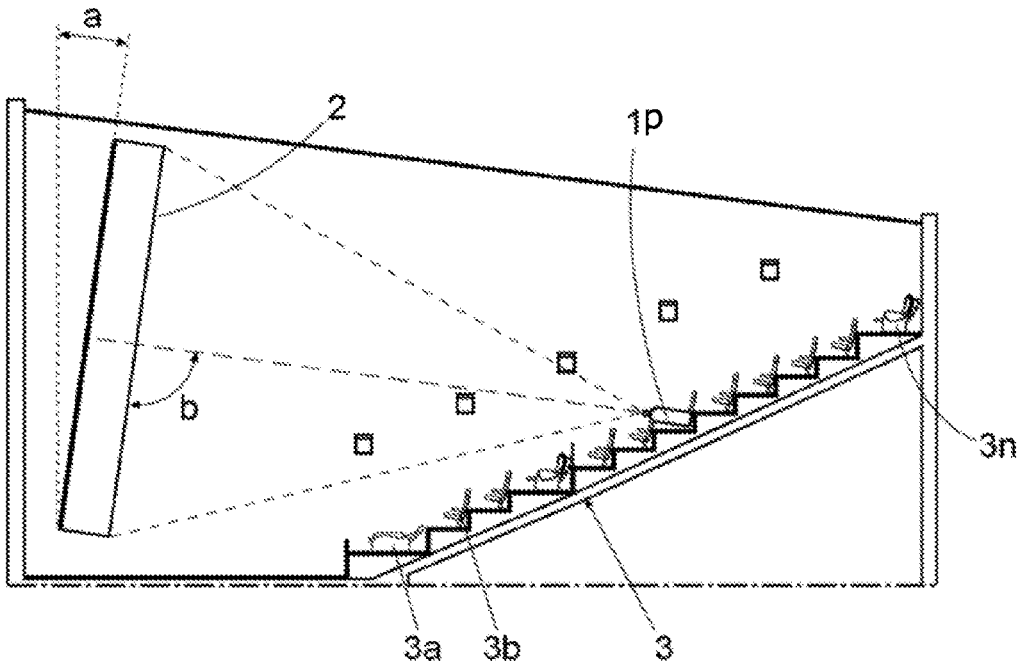
FIG. 6 shows an elevation view of a cross section of the cinema room of FIG. 1.

FIGS. 5 and 6 illustrate a cinema room for a multi-screen cinema, having a film projector (1*p*), a projection screen (2) and the tiers of seats (3) with multiple rows of seats (3*a*, 3*b*, . . . , 3*n*). As is to be seen from the annexed figures of drawings, the movie projection screen (2) has a surface in the form of a cylindrical sector, with constant curvature, being inclined towards the low frontal area as may be observed in FIG. 6, forming an angle (a) with a vertical line comprised between 5° and 10°, preferably 7°. Said screen (2) has format 1:1.86 which corresponds to a chip format used in digital projectors.

The movie projector (1*p*) is integrated in an intermediate area of the tiers of seats (3), between the seats and directed towards the centre of the screen (2) forming with said screen (2) an angle comprised between 80° and 100°, preferably 90°; so that a high utilization of the light coming from the film projector (1*p*) is obtained as well as an absolute maintenance of the projecting formats in which the film has been created.

Figure 7:
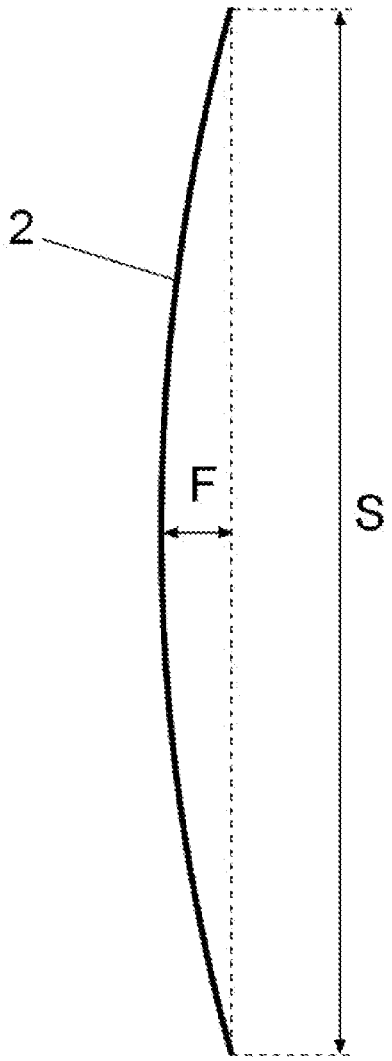
FIG. 7 shows a vertical projection of the screen for the cinema room corresponding to FIGS. 5 and 6, showing the cross section of the cylindrical sector forming said screen, as well as the height and secant of the cylindrical sector shaped screen.

As may be observed in FIG. 7, the cylindrical sector-like surface defined by the screen (2) has a height (F) as well as a secant (S) with a length ratio comprised between 1:15 and 1:20.

As is to be observed in FIGS. 5 and 6, the first row (3*a*) of the tiers of seats has bed-like seats, which objective is to permit the viewers using the same to arrange themselves lying or seated with a higher inclination than the rest of seats in the other rows of seats (3*b*, . . . , 3*n*) improving the visualization of the screen.

Further Embodiments

Further embodiments, aspects and examples are defined in the following to facilitate the understanding of the invention:

1. An arrangement of cinemas in multiplex cinemas, comprising: at least one first row (1) of contiguous cinemas (1*a*) provided with a projection screen (P) and with stadium-type seating (G) arranged on an inclined surface (15); wherein the cinemas (1*a*) of the first row have a trapezoidal layout with: a larger end (11) where the projection screen (P) is arranged, a smaller end (12), and two oblique sides (13, 14), said cinemas (1*a*) being attached to one another by their sides and with their larger and smaller ends (11, 12) oriented in opposite directions with respect to said ends of the contiguous cinema or cinemas (1*a*) of the same row (1).
2. The arrangement according to 1, the lower cinemas (2*a*) having a trapezoidal layout provided with: a smaller end (21), a larger end (22) and two oblique sides, said lower cinemas (2*a*) being arranged below the inclined surface (15) of the cinemas (1*a*) of the first row.
3. The arrangement according to 2, the smaller end (21) of the lower cinemas (2*a*) being oriented in the same direction and vertically aligned with the smaller end (12) of the contiguous cinemas (1*a*) of the first row.
4. Arrangement for a cinema room for a multi-screen cinema, in which each of the cinema rooms has a film projector (1*p*), a screen (2) and tiers of seats (3) with multiple rows of seats (3*a*, 3*b*, . . . , 3*n*) arranged to different heights; wherein the screen (2) has a surface in form of a cylindrical sector with a constant curvature, being inclined towards the stands forming an angle (a) with respect to a vertical line comprised between 5° and 10° and in that the film projector (1*p*) is integrated in an intermediate area of the tiers of seats (3), oriented towards the centre of the screen, forming with the screen (2) an angle (b) comprised between 80° and 100°.
5. The arrangement according to 4, wherein the surface in form of a cylindrical sector of the screen (2) has a height (F) and a secant (S) with a length ratio comprised between 1:15 and 1:20.
6. The arrangement according to 5, wherein the screen has a format of 1:1.86.
7. The arrangement according to 4, wherein the angle (a) of the screen (2) with respect to a vertical line is of 7°.
8. The arrangement according to 4, wherein the angle (b) formed by the film projector (1*p*) in respect to the screen (2) is of 90°.
9. The arrangement according to 4, wherein at least the first row of seats (3*a*) has bed-like seats in which the viewers can arrange themselves lying or seated with a higher inclination than in the rows of seats located behind (3*b*, . . . , 3*n*).

Having sufficiently described the nature of the invention as well as a preferred embodiment, it is hereby stated for all relevant purposes that the materials, shape, size and arrangement of the described elements may be modified provided that it does not entail an alteration of the essential features of the invention which are claimed below.

The invention claimed is:

1. An arrangement of cinemas in multiplex cinemas, comprising: at least one first row (1) of contiguous cinemas (1*a*) provided with a projection screen (P) and with stadium-type seating (G) arranged on an inclined surface (15); wherein the cinemas (1*a*) have a trapezoidal layout with: a larger end (11) where the projection screen (P) is arranged, a smaller end (12), and two oblique sides (13, 14), said cinemas (1*a*) being attached to one another by their sides and with their larger and smaller ends (11, 12) oriented in opposite directions with respect to said ends of the contiguous cinema or cinemas (1*a*) of the same row (1).

2. An arrangement of cinemas in multiplex cinemas, comprising: at least one first row (1) of contiguous cinemas (1*a*) provided with a projection screen (P) and with stadium-type seating (G) arranged on an inclined surface (15); wherein the cinemas (1*a*) have a trapezoidal layout with: a larger end (11) where the projection screen (P) is arranged, a smaller end (12), and two oblique sides (13, 14), said cinemas (1*a*) being attached to one another by their sides and with their larger and smaller ends (11, 12) oriented in opposite directions with respect to said ends of the contiguous cinema or cinemas (1*a*) of the same row (1), lower cinemas (2*a*) having a trapezoidal layout provided with: a smaller end (21), a larger end (22) and two oblique sides, said lower cinemas (2*a*) being arranged below the inclined surface (15) of the cinemas (1*a*) of the first row.

3. An arrangement of cinemas in multiplex cinemas, comprising: at least one first row (1) of contiguous cinemas (1*a*) provided with a projection screen (P) and with stadium-type seating (G) arranged on an inclined surface (15); wherein the cinemas (1*a*) have a trapezoidal layout with: a larger end (11) where the projection screen (P) is arranged, a smaller end (12), and two oblique sides (13, 14), said cinemas (1*a*) being attached to one another by their sides and with their larger and smaller ends (11, 12) oriented in opposite directions with respect to said ends of the contiguous cinema or cinemas (1*a*) of the same row (1), lower cinemas (2*a*) having a trapezoidal layout provided with: a smaller end (21), a larger end (22) and two oblique sides, said lower cinemas (2*a*) being arranged below the inclined surface (15) of the cinemas (1*a*) of the first row, the smaller end (21) of the lower cinemas (2*a*) being oriented in the same direction and vertically aligned with the smaller end (12) of the contiguous cinemas (1*a*) of the first row.

* * * * *